United States Patent [19]

Cuculo et al.

[11] Patent Number: 4,909,976

[45] Date of Patent: Mar. 20, 1990

[54] PROCESS FOR HIGH SPEED MELT SPINNING

[75] Inventors: John A. Cuculo; Paul A. Tucker; Gao-Yuan Chen; Chon-yie Lin; Jeffrey Denton; Ferdinand Lundberg, all of Raleigh, N.C.

[73] Assignee: North Carolina State University, Raleigh, N.C.

[21] Appl. No.: 191,446

[22] Filed: May 9, 1988

[51] Int. Cl.[4] ..... D01F 6/62

[52] U.S. Cl. ..... 264/211.15; 264/211.17; 264/234; 264/237; 264/345; 264/348

[58] Field of Search ..... 264/211.15, 211.18, 264/234, 237, 345, 348, 211.17

[56] References Cited

U.S. PATENT DOCUMENTS 3,946,100 3/1976 Davis et al. ..... 264/211.15

4,195,051 3/1980 Frankfort et al. ..... 264/210.2

FOREIGN PATENT DOCUMENTS 042664 12/1981 European Pat. Off. .

140559 5/1985 European Pat. Off. .

207489 1/1987 European Pat. Off. .

244217 11/1987 European Pat. Off. .

*Primary Examiner*—Hubert C. Lorin

*Attorney, Agent, or Firm*—Bell, Seltzer, Park & Gibson

[57] ABSTRACT

The high speed melt spinning of synthetic polymer fibers is provided with on-line zone heating and cooling by which the strand emerging from the spinneret is initially cooled to an optimum temperature above the glass transition point of the polymer, the maintained near that temperature for a period of time to promote development of desirable fiber properties such as crystallization and crystal orientation, and then finally cooled below the solidification point for take up.

10 Claims, 12 Drawing Sheets

PROCESS FOR HIGH SPEED MELT SPINNING

BACKGROUND OF THE INVENTION

This invention is an improvement to the high speed melt spinning of synthetic polymer fibers. Via this invention, the structure and properties of the as-spun fibers such as orientation, density, crystallinity and tensile properties are significantly improved for spinning in the high speed range. This approach may be applicable to the melt spinning process of several different synthetic polymers. It is expected that the orientation and crystallinity of any melt spinnable polymers with relatively low crystallization rates can be increased by this approach.

Many factors influence the development of threadline orientation and crystallinity in the conventional melt spinning process, in which molten filaments are extruded from spinneret holes and are usually rapidly cooled to room temperature by a cross-flow air quench. The fibers so produced normally possess low orientation and crystallinity at low take-up speeds. Since orientation of the as-spun fibers increases almost linearly with increasing take-up speed, take-up speed has historically been the most effective parameter in controlling the structure development in the threadline. Medium speeds between 2500–4500 m/min yield partially oriented yarns (POY) which, due to low crystallinity, have too much elongation potential and creep, or non-removable potential elongation, for use in most textile applications. Characteristically, however, significant crystallization starts to develop in the threadline as take-up speeds exceed 4500 m/min, producing more fully oriented fibers.

An ideal industrial process for synthetic fiber spinning should be simple and effective and should yield fibers having a high degree of orientation and crystallinity. Most commercial synthetic fibers are presently manufactured by a coupled two-step process (TSP): (i) spinning at low speeds of approximately 1000–1500 m/min to produce fibers having a relatively low degree of orientation and crystallinity; and (ii) drawing and annealing under certain conditions to increase the orientation and crystallinity in the fibers. However, because of the crystallization characteristic of synthetic polymers, much academic and industrial research has in recent years focused on developing a one-step process (OSP) for high speed spinning. Numerous patents and publications concerning high speed spinning by many investigators have recently appeared, and the book *High Speed Fiber Spinning* gives a literature and patent survey of recent developments in high speed spinning. Ziabicki and Kawai, Eds., *High Speed Fiber Spinning*, Wiley Interscience, New York (1985).

Many technical problems have been encountered in adapting current production schemes in the course of developing an OSP for high speed spinning. For example, a speed limit exists at which fiber orientation, crystallinity, and many other properties are maximized, implying that take-up speed cannot be infinitely increased under existing spinning conditions. Frequent filament breakage, high skin-core differences in fiber structure and low amorphous orientation are also encountered at very high take-up speeds.

To avoid or minimize the above problems, several techniques have been developed for spinning fibers at high take-up speeds. A common practice is to delay the quench rate of the molten filament. Yasuda studied the effect on polyethylene terephthalate (PET) of varying cooling air temperature from 22° C. to 98° C. and found that the differential birefringence ($\delta\Delta n$) of PET decreased as cooling air temperature increased. *High Speed Fiber Spinning* at Ch. 13, p. 363. Frankfort placed a heated sleeve immediately below the spinneret to delay the quench rate U.S. Pat. No. 4,134,882. Use of a high length-to-diameter ratio (L/D) in the capillary die, a modification believed to raise the surface temperature of the extrudate, has also been reported to reduce $\delta\Delta n$.

Vassilatos et al. used hot air to slow the cooling rate of the entire spinline, in order to decrease excessive spinline breaks at speeds above 6400 m/min. *High Speed Fiber Spinning* at Ch. 14, p. 390. However, slowing the cooling rate with hot air or other means alone cannot lead to an increase in either birefringence or crystallinity, probably because the relaxation time of the polymer molecules decreases with increasing temperature. When the cooling of the molten filament is materially delayed by use of a heated sleeve or flow of hot air around the fiber, considerable deformation occurs in the relatively high temperature region and flow-induced orientation is readily relaxed. However, if the molten filament is initially cooled very rapidly, the temperature of the filament can be brought to an optimum temperature to effectively obtain a flow-induced orientation which can be retained without significant thermal relaxation. This characteristic is likely related to the increased relaxation time and theological stress of synthetic fibers due to their greater viscosity at low temperatures. The mechanism of structure formation in melt spun fibers is complex since it is not an isothermal process. The crystallization rate of a threadline depends upon both the temperature and the level of molecular orientation induced by melt flow in the threadline. Since flow-induced orientation is influenced by the development of the deformation, minimizing thermal relaxation while deforming the fiber rapidly at a relatively low temperature should achieve a high level of orientation. Under certain conditions, molecular orientation increases with increasing deformation rate, which is in turn proportional to take-up velocity. Increased flow-induced orientation therefore results in a high rate of crystallization and crystallinity in the fibers spun.

Many researchers have observed a necking phenomenon occurring in PET fibers during the high speed spinning process and report that the filament is essentially amorphous above the necking zone whereas crystallinity is either maximized or unchanged afterwards. Necking may therefore indicate the region of the maximum rate of crystallization in the threadline. Recent studies show the neck occurring in the threadline at a distance varying between 130 cm and 50 cm from the spinneret for speeds ranging from 4000 m/min to 7000 m/min, respectively, so that the neck moves closer to the spinneret as take-up speed increases. threadlines temperature at the neck also increases from 130° C. to 180° C. with increasing speed. George, Holt, and Buckley, *Polym. Eng. & Sci.*, Vol. 23, 95 (1983). The crystallinity of the spun fiber and its level of crystal orientation can be increased or even maximized by maintaining the filament near optimum conditions for a relatively long time since final crystallinity is an integration of the crystallization rate and crystallization time.

Previous studies obtained ultra-oriented PET strands by using convergent die geometries to produce an elongational flow field. Ledbetter, Cuculo, and Tucker, *J.*

*Polym. Sci., Polym. Chem. Ed.* Vol. 22, 1435 (1984), Ihm and Cuculo, *J. Polym. Sci., Polym. Physics Ed.*, Vol. 25, 2331 (1987). Application of high pressure to the polymer flowing through the convergent die produced rapid crystallization which effectively locked in the molecular orientation induced by the elongational flow. The birefringence of the oriented strands, was between 0.196 and 0.20, which is higher than that of conventional, fully drawn yarn. The present invention extends that work from a batch process to a continuous one.

SUMMARY OF THE INVENTION

The present invention modifies threadline dynamics in high speed melt spinning by using on-line zone cooling and heating (OLZH). Molten polymer is extruded through spinneret holes at high speeds at or above 3000 m/min. After passing through the spinneret, the emerging polymer strands pass through a cooling means by which they are rapidly cooled to an optimum temperature range. This temperature range is that at which the polymer being extruded exhibits the most desirable crystallization and crystal orientation development characteristics, and its exact values depend on both the material being extruded and the spinning speed.

After passing through the initial zone of rapid cooling, the molten strands next pass through a heating means which maintains the molten strands at a temperature within their optimum temperature range. The temperature of the strands while within the heating means may either be allowed to vary between the maximum and minimum temperatures of the optimum range or maintained at substantially isothermal conditions. By assuring that the strands remain within the optimum temperature range for a certain brief period of time, the heating means increases the crystallinity and crystal orientation in the strands and drastically improves their tensile properties.

After passing through the heating means, the molten strands pass into a second cooling zone. Here they are cooled from a point within their optimum temperature range to a temperature below the glass transition and solidification temperatures. After passing through this final cooling zone, the solidified strands are taken up at a high rate of speed.

In the traditional continuous melt spinning process, flow induced orientation is easily relaxed out due to thermal randomization. However, since the current invention rapidly cools the upper portion of the molten filament before maintaining it at optimum conditions for maximum crystallization rate and crystallinity, it effectively locks in the flow-induced orientation in the threadline. Also, radial variations in fiber structure should be minimized by the isothermal surroundings created by the use of on-line zone heating which reduces the radial distribution of temperature across the filament.

Gupta and Auyeung recently modified the threadline dynamics of PET fibers at low spinning speeds ranging from 240 m/min to 1500 m/min. Gupta and Auyeung, *J. Appl. Polym. Sci.*, Vol. 34, 2469 (1987). They employed an insulated isothermal oven located at 5.0 cm below the spinneret and observed an increase in the crystallinity of spun fibers at speeds between 1000 m/min to 1500 m/min; however, their process required a very long heating chamber of about 70 cm and temperatures as high as 220° C. No significant effects of heating were observed at lower temperatures (e.g., 180° C.) or with shorter length ovens. Use of the long heating oven at high temperature caused unstable spinning at a very low spinning speed below 1500 m/min due either to a (i) chimney effect of the long oven pipe, which causes air turbulence around the threadline, or (ii) large temperature fluctuations in the air surrounding the filament, which generates draw resonance in the spinline. X-ray patterns show their samples to be highly crystallized but poorly oriented, unlike those produced by the present invention, which may imply that the crystallization undergoes a different mechanism in their low speed process than that in the high speed process of the present invention. At the low take-up speed of Gupta, the time for the filament to pass through a long hot chamber is relatively long, and crystallization occurs in both unoriented and oriented regions to yield poorly oriented crystallites. In contrast, the short heating chamber and high spinning speed of the present invention result in a residence time too short for crystallization of the unoriented region, thus, crystallization develops from highly oriented precursors at an extremely high rate to produce highly oriented crystalline structures.

Due to its different crystallization mechanism, the present invention uses a very short heating chamber, 13 cm long at 4000 m/min, which is very effective in modifying the threadline dynamics of PET fibers. The air temperature in the heated chamber can be controlled within ±1° C. to avoid temperature fluctuations which would produce draw resonance. Under these conditions, stable spinning of PET can be obtained in the high speed range above 3000 m/min and up to 7000 m/min.

This summary is meant to provide a brief overview of the present invention and some of its applications. The present invention and its significance will be further understood by one skilled in the art from a review of the complete specification including the drawings and the claims.

BRIEF DESCRIPTION OF THE DRAWING FIGURES

Some of the features and advantages of the invention having been stated, others will become apparent from the detailed description which follows, and from the accompanying drawings, in which FIG. 1 is a schematic drawing illustrating an embodiment of the system of the present invention.

DESCRIPTION OF THE PREFERRED EMBODIMENT

It has now been found that the spinning of the synthetic fibers at high speed can be modified to provide one-step process which produces fibers having superior characteristics. The present invention utilizes on-line zone cooling and heating to modify the cooling of the extruded fiber strands after they emerge from the spinneret. The use of on-line zone cooling and heating at high spinning speeds significantly increases fiber orientation and crystallinity and drastically improves fiber tensile properties.

Figure 1:
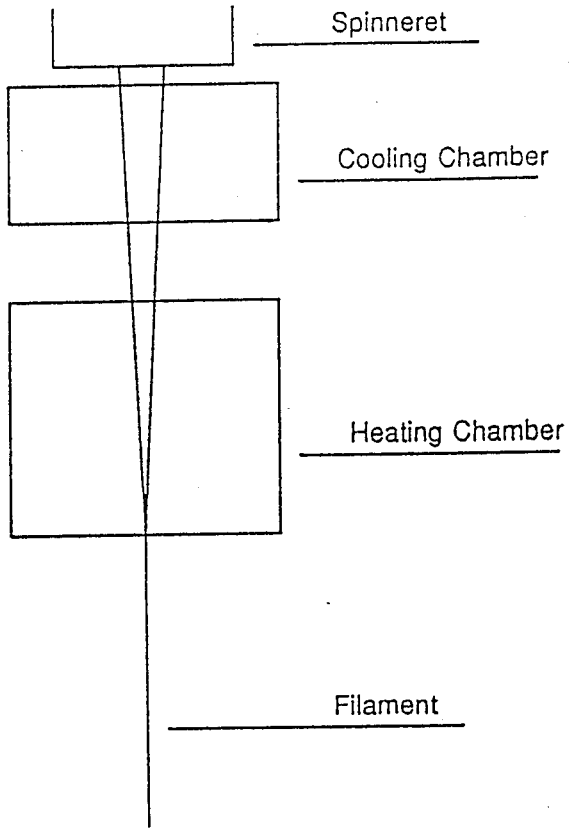

In the preferred system, depicted in FIG. 1, strands 10, in the form of a group of continuous filaments of polymer material, are extruded from a spinneret 12. After being formed by extrusion strands 10 move continuously downward as a result of a tensile force acting upon their ends farthest from spinneret 12. As the strands move away from spinneret 12 they pass successively through cooling chamber 13 and a heating chamber 14. Cooling chamber 13 directs cool air into contact with the strands to rapidly cool the strands to a predetermined optimum temperature before passing into heating chamber 14. The heating chamber 14 directs heated air into contact with the strands to maintain them within an optimum temperature range for a brief period of time. The optimum temperature range maintained by heating chamber 14 is the range over which the material being extruded will develop the most desirable crystallization and crystal formation properties. The temperatures within this range depend on the particular polymer being extruded and the spinning speed.

After passing out of heating chamber 14, the strands pass through a second cooling zone 15 where they are again contacted with cool air and are cooled further to a temperature below the glass transition and solidification temperatures of the polymer being used. The strands are then wound into a package on a suitable take up device 16 which maintains a tensile force along the strands and keeps them in motion.

EXAMPLE

The present invention will be more fully understood from the illustrative example which follows, and by reference to the accompanying drawings. Although a specific example is given, it will be understood that this invention can be embodied in many different forms and should not be construed as limited to the example set forth herein.

A polyethylene terephthalate (PET) sample having an intrinsic viscosity (IV) of 0.57 was extruded at a spinning temperature of 295° C. with a take up denier of approximately 5.0 and a 0.6 millimeter hyperbolic spinneret. High speed spinning take up speeds of 3000 m/min or higher were used. Cooling chamber 13 was of a cylindrical design 20 cm long and 8.3 cm inside diameter and was located 13 cm below the spinneret. It used an air flow of 300 feet per minute at room temperature, approximately 23° C., to create the initial zone of rapid cooling. Heating chamber 14 likewise had a cylindrical design 9 cm long and 8.1 cm inside diameter, and was used at a distance inversely proportional to take up speed to create a heated zone around strand 10. The temperature within the heating chamber was controllable within 1° C., and the heating temperatures used varied between 80° C. and 160° C. Due to the high take up speeds of high speed spinning, strand 10 remained in heating chamber 14 for a time less than 0.005 seconds. At a take up speed of 3000 m/min, the PET strand of the preferred embodiment remained in the heating zone for approximately 0.004 seconds; as take up speed increased, the time the strand was heated decreased.

Figure 2:
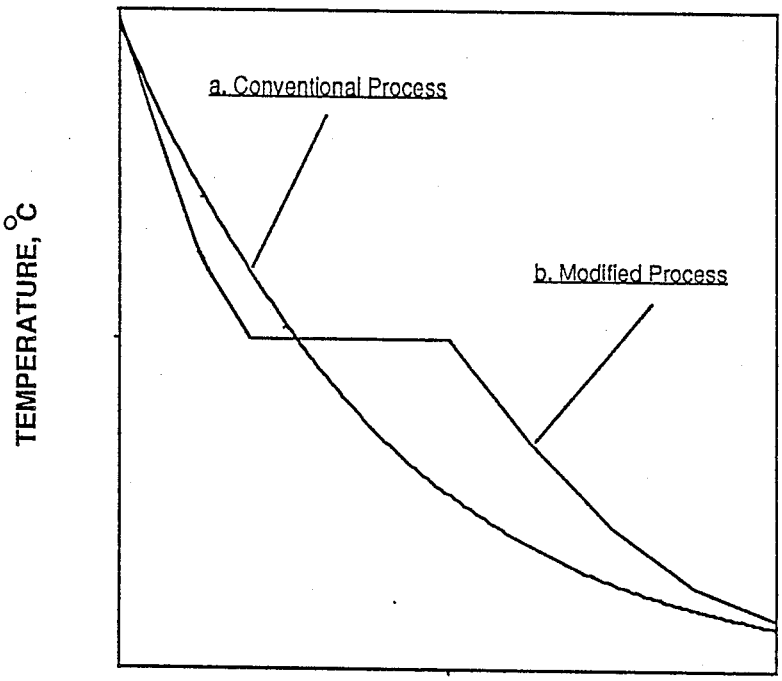
FIG. 2 is a graph illustrating the cooling temperature profile for strands in conventional high speed melt spinning and for high speed melt spinning as modified by the present invention.

FIG. 2 illustrates the temperature profiles of strand 10 in (a) conventional high speed spinning and (b) high speed spinning utilizing the present invention. The temperature of the strand in the conventional high speed spinning process generally decreases monotonically with distance from the spinneret until reaching ambient temperature; however, the inclusion of cooling chamber 13 and heating chamber 14 alters the temperature profile and creates an initial area of rapid cooling followed by a zone of retarded cooling which may be virtually isothermal. The present invention improves strand structure and properties by creating this altered temperature profile.

CHARACTERIZATION METHOD AND RESULTS

Fiber birefringence (an indication of molecular orientation in a fiber) was determined with a 20-order tilting compensator mounted in a Nikon polarizing light microscope. Fiber density (d) was obtained with a density gradient column ($NaBr-H_2O$ solution) at 23±0.1° C. Birefringence and density data are averages. Weight fraction crystallinity ($x_c$, wt%) and volume fraction crystallinity ($x_c$, vl%) were calculated using the following equation:

$$x_c,\ \text{wt.\%} = [(d-d_a^o)/(d_c^o-d_a^o)]\cdot(d_c^o/d).100\% \quad (1)$$

$$x_c,\ vl\% = [(d-d_a^o)/(d_c^o-d_a^o)].100\% \quad (2)$$

where d is the density of fiber sample, $d_c^o$ is the density of crystalline phase equal to 1.455 g/cc and $d_a^o$ is the density of amorphous phase equal to 1.335 g/cc (R. P. Daubeny, C. W. Bunn, and C. J. Brown, Proc. Roy. Soc. (London), A226, 531, 154).

Wide angle x-ray scattering (WAXS) patterns of fiber samples were obtained with nickel-filtered CuKα radiation (30 kv, 20 mA) using a flat-plate camera. Film-to-sample distance was 6 cm. A Siemens Type-F x-ray diffractometer system was employed to obtain equatorial and azimuthal scans of fiber samples. The crystalline orientation factor (fc) was calculated using the Wilchinsky method from (010), (110) and (100) reflection planes (Z. W. Wilchinsky, *Advances in X-ray Analysis*, vol. 6, Plenum Press, New York, 1963). The amorphous orientation factor ($f_{am}$) was determined using the following equation:

$$\Delta^n = \Delta^n c^*.f_c.x_c + \Delta^n am^*.f_{am}.(1-x_c) \quad (3)$$

where $\Delta^n$ is the total birefringence, $\Delta^n c^*(=0.22)$ and $\Delta^n am^*(=0.19)$ are the intrinsic birefringence of the crystalline and amorphous regions, respectively. $X_c$ is the volume fraction crystallinity calculated from the density. The apparent crystal sizes were determined according to the Scherrer equation:

$$L_{hkl} - {}^{80}/\beta\cos\theta \quad (4)$$

where $\beta$ is the half width of the reflection peak, $\theta$ is the Bragg angle, and $\lambda$ is the wavelength of the X-ray beam. Three strong reflection peaks, (010), (110) and (100) were selected and resolved using the Pearson VII method (H.M. Heuvel, R. Huisman and K.C.J.B. Lind, *J. Polym. Sci. Phys. Ed.*, Vol. 14, 921 (1976)).

Figure 3:
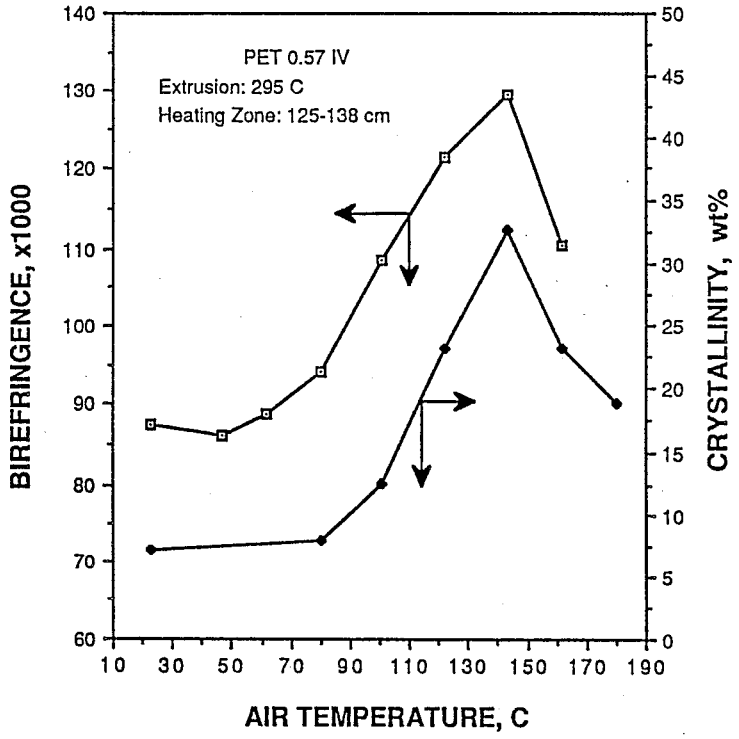
FIG. 3 is a graph showing the variation of birefringence and crystallinity with the air temperature of on-line zone heating at 4000 m/min.

The Differential Scanning Calorimetry (DSC) curves of the fibers were obtained with a Perkin-Elmer differential scanning calorimeter model DSC-2 equipped with a thermal analysis data station. All DSC curves were recorded during the first heating of samples weighing approximately 8 mg at a heating rate of 10 K/min. Also, tensile testing was performed on an Instron machine model 1123. Test method ASTM D3822-82 was followed. All tests were done on single strands using a gage length of 25.4 mm and a constant cross head speed of 20 mm/min. An average of 10 individual tensile determinations was obtained for each sample. FIG. 3 shows that, at a take-up speed of 4000 m/min, the birefringence and crystallinity of the as-spun PET fibers increase remarkably when the air temperature of the zone heating chamber exceeds 80° C., which is just above the glass transition temperature of PET. Both the birefringence and crystallinity achieve maximum values at about 140° C. at the given take-up speed. Further increase in the air temperature caused decreases in birefringence and crystallinity.

Figure 4A:
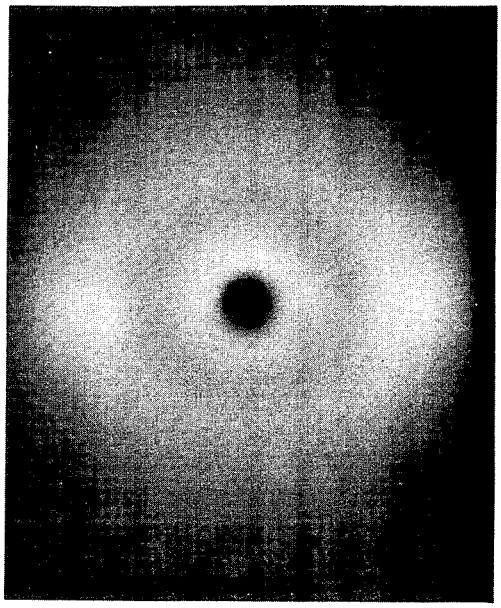
FIG. 4 illustrates WAXS patterns of PET fibers produced by high speed spinning with and without use of the present invention.
Figure 4B:
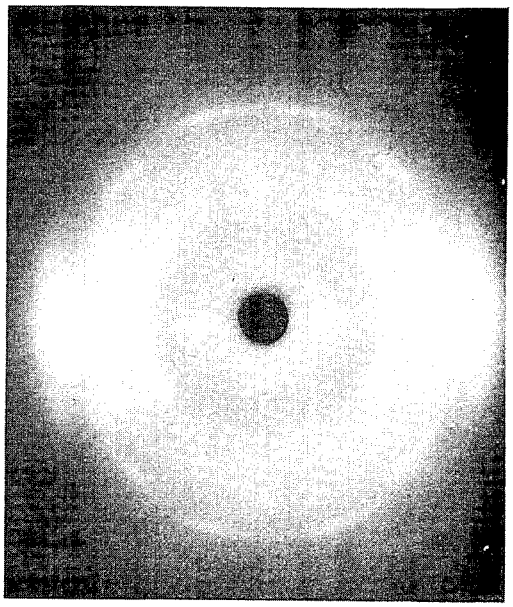

FIG. 4 shows the WAXS patterns of two PET fibers. Sample (a) was produced under conventional high speed spinning conditions, i.e., regular cooling to ambient temperature and no use of zone heating. Sample (b) was produced using zone heating and cooling. The heating chamber, 13 cm long and 8.1 cm inside diameter, was placed 125 cm below the spinneret at 140° C. Both fibers were spun at 4000 m/min. Sample (a) shows a diffuse amorphous halo which is typical of PET fibers spun at 4000 m/min, whereas sample (b) exhibits three distinct equatorial arcs. This indicates that the orientation and crystallinity of the fiber in the sample produced by the present invention is much more fully developed than for fibers produced by conventional spinning. This result is consistent with the measurements of fiber birefringence and crystallinity as shown earlier in FIG. 3.

Figure 5:
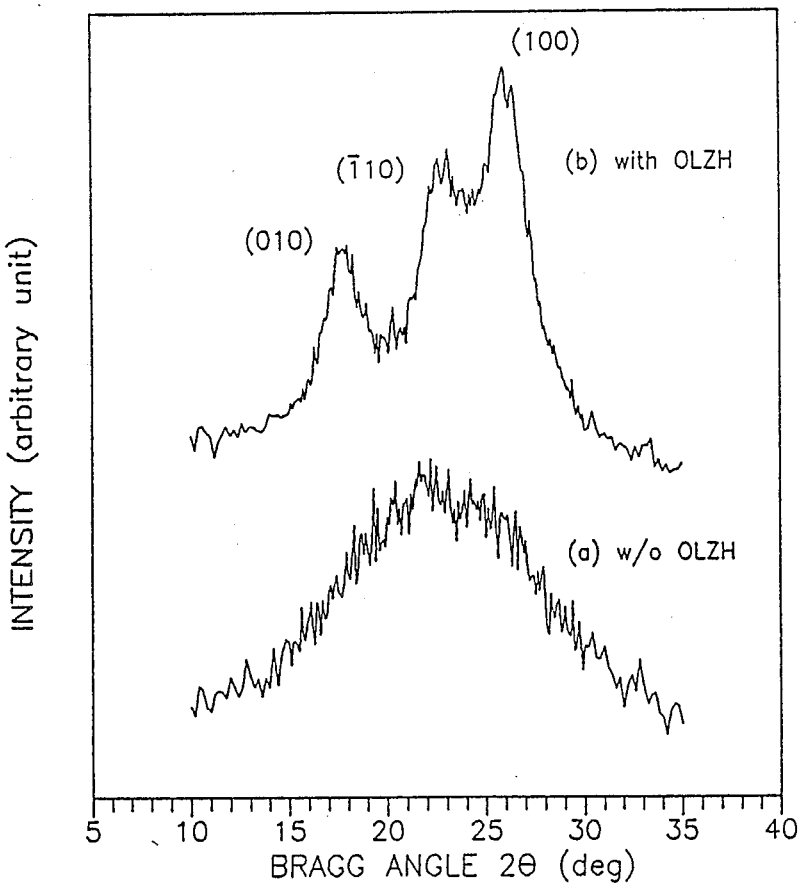
FIG. 5 is a graph of WAXS equatorial scans of two kinds of PET fibers produced by high speed spinning with and without the present invention.

More detailed and quantitative information may be obtained from the diffractometer scans. FIG. 5 shows the equatorial scans of the two samples discussed in FIG. 4. The fiber produced by conventional spinning has a broad unresolved pattern typical of amorphous materials; however, the fiber obtained with zone cooling and heating yields a well resolved pattern. The resolved peaks correspond to three reflection planes, (010), ($\bar{1}$10) and (100), as indicated in the figure.

Figure 6:
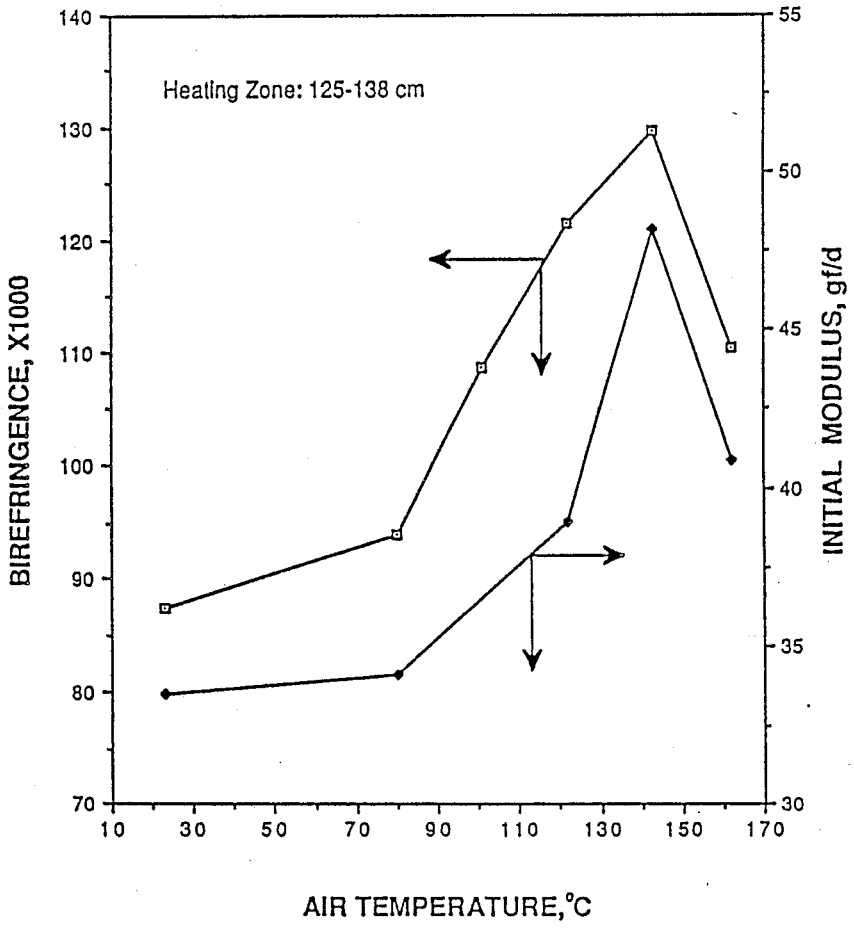
FIG. 6 is a graph of birefringence and initial modulus as a function of heating zone temperature at 4000 m/min take up speed.
Figure 7:
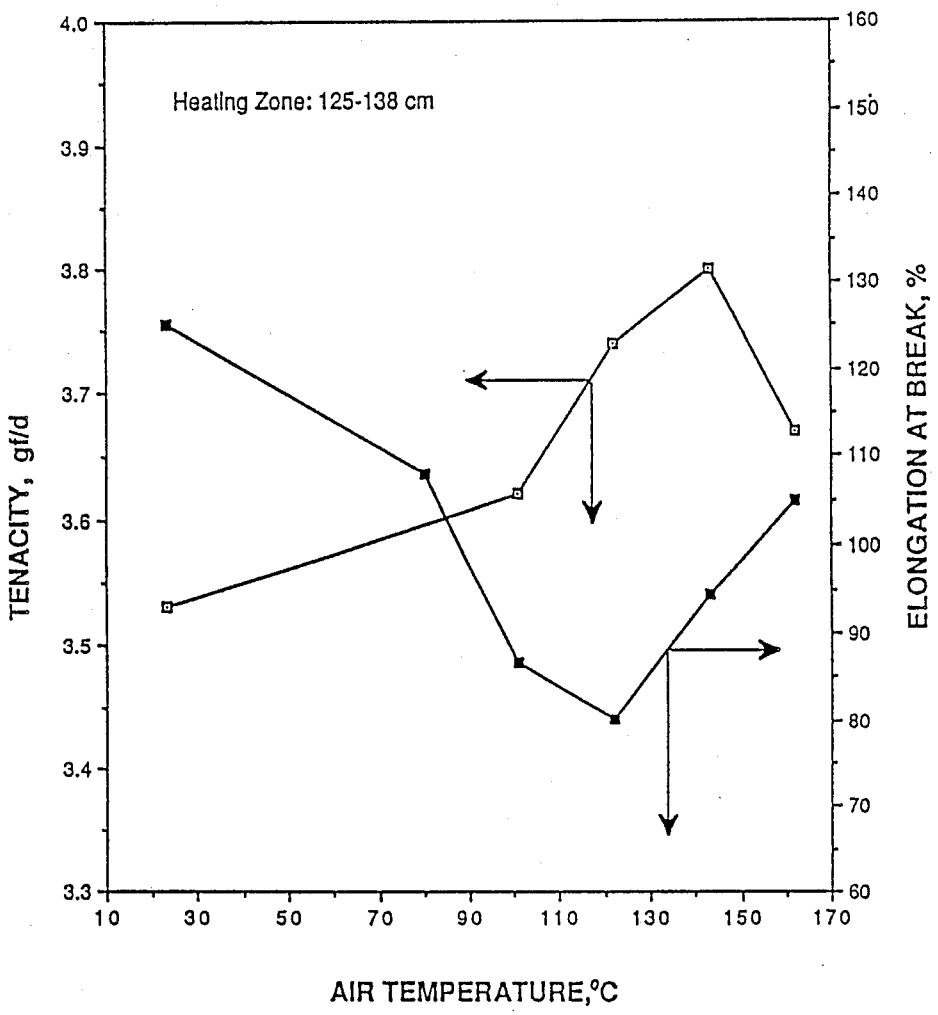
FIG. 7 is a graph of tenacity and elongation at break as function of heating zone temperature at 4000 m/min take up speed.

FIGS. 6 and 7 show the variation of tensile properties at different heating temperatures for spinning at 4000 m/min. The initial modulus of the fibers shown in FIG. 6 changes with the air temperature in almost the same way as does the birefringence, also reproduced in the figure. FIG. 7 shows that the tenacity of the fibers produced is maximized at a heating temperature of about 140° C., whereas the elongation at break decreases with increasing air temperature from 23° C. to 120° C. and then increases. These changes in tensile properties are due to the changes of molecular orientation and crystallinity in the fibers. Highly oriented, highly crystallized fibers usually exhibit high modulus, high strength and lower elongation at break. Therefore, these observations confirm that the present invention significantly affects the fiber structure development in the threadline and improves the mechanical properties of the fiber.

Figure 8:
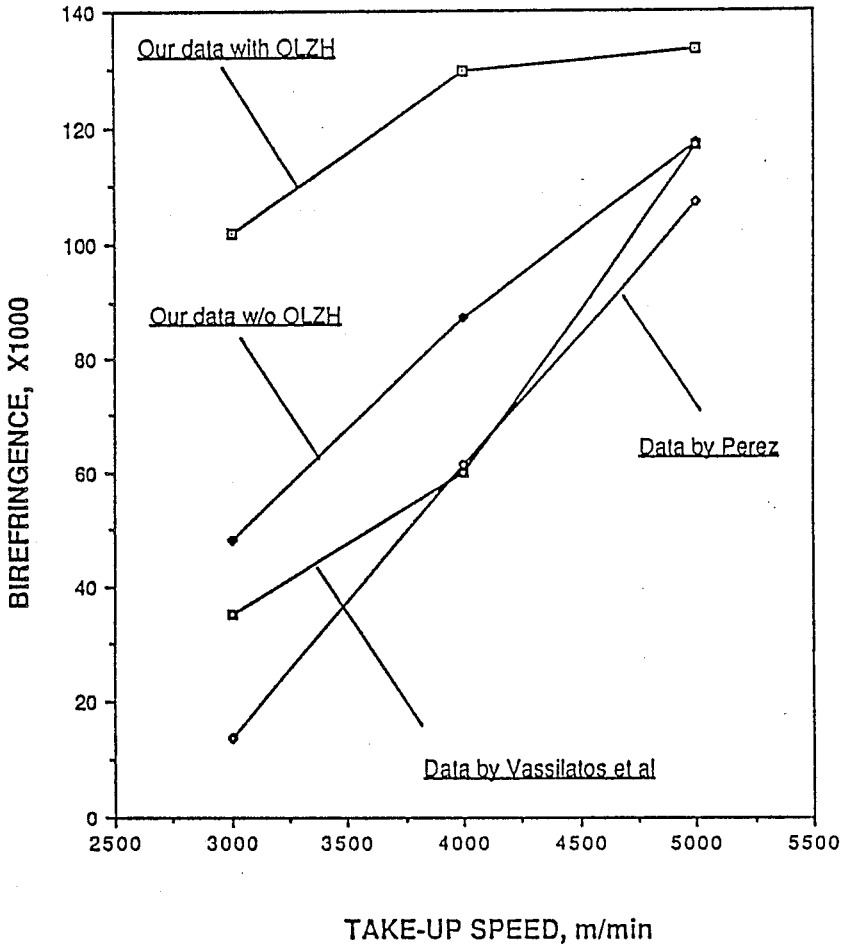
FIG. 8 is a graph illustrating the effect of the present invention on fiber birefringence at varying take up speeds.

Similar effects were also observed at other take-up speeds. FIG. 8 shows the effect of zone cooling and heating on birefringence at three different take-up speeds: 3000 m/min, 4000 m/min, and 5000 m/min. Heating conditions were adjusted for each take-up speed for optimum results. The heating chamber was placed at 125 cm from the spinneret for 3000 and 4000 m/min takeup speeds, whereas it was positioned at 50 cm below the spinneret for 5000 m/min. Hot air at temperatures of 120° C., 143° C. and 160° C. were used for the take-up speeds of 3000, 4000, and 5000 m/min, respectively. Significant increases in the fiber birefringence were achieved via on-line heating and cooling at each take-up speed.

Figure 9:
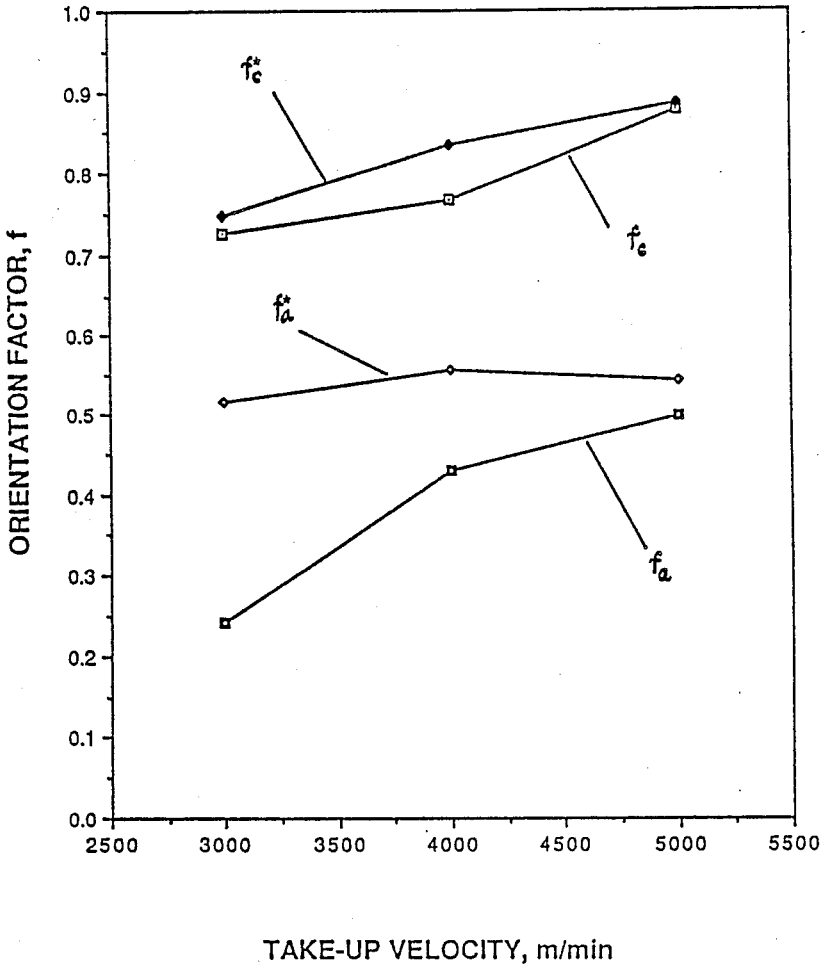
FIG. 9 illustrates the effect of the present invention on crystalline and amorphous orientation factors.
Figure 10:
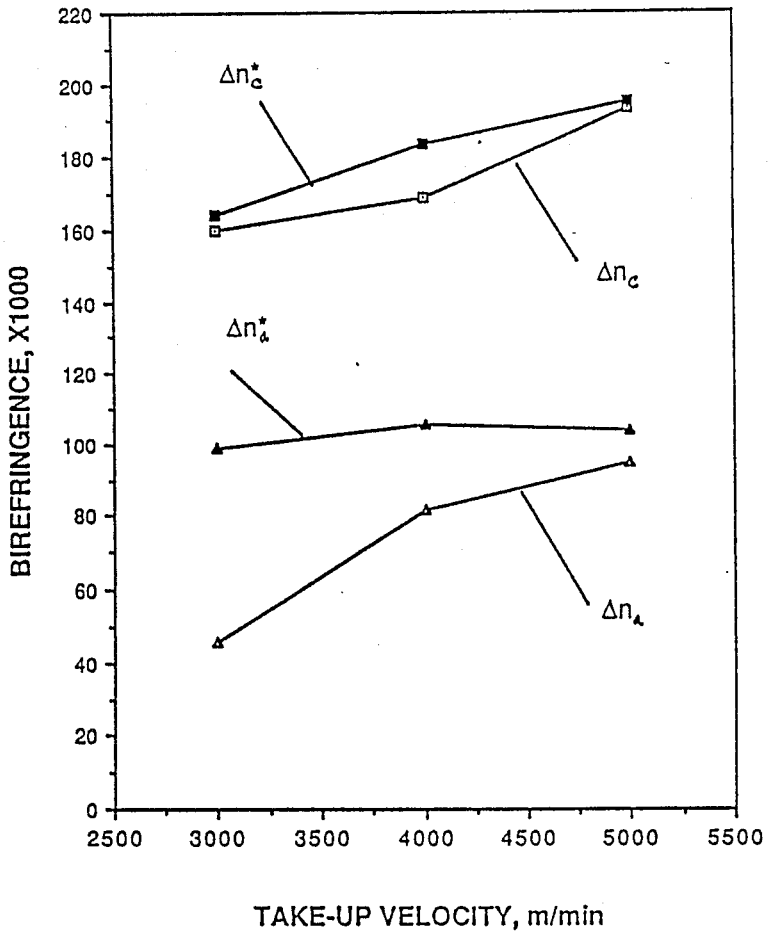
FIG. 10 is a graph illustrating the effect of the present invention on crystalline and amorphous birefringence.

The crystalline orientation factors of the fibers were calculated by analyzing the WAXS scans of the fiber samples. Based on the birefringence data and calculated volume fraction crystallinity, amorphous orientation factors were calculated using equation (3) and are shown in FIG. 9. The data obtained shows that the crystalline orientation factors are obviously increased at 4000 m/min when on-line cooling and heating is used; however, the effect on the crystalline orientation factor is not obvious at 3000 m/min and 5000 m/min. The amorphous orientation factor, as shown in the figure, is greatly increased by the present invention over the entire high speed spinning range used. FIG. 10 shows the calculated birefringence in the crystalline and amorphous regions, respectively; results are similar to those shown in FIG. 9. Both the orientation factor and the birefringence of the amorphous regions are lower than those in the crystalline regions.

Figure 11:
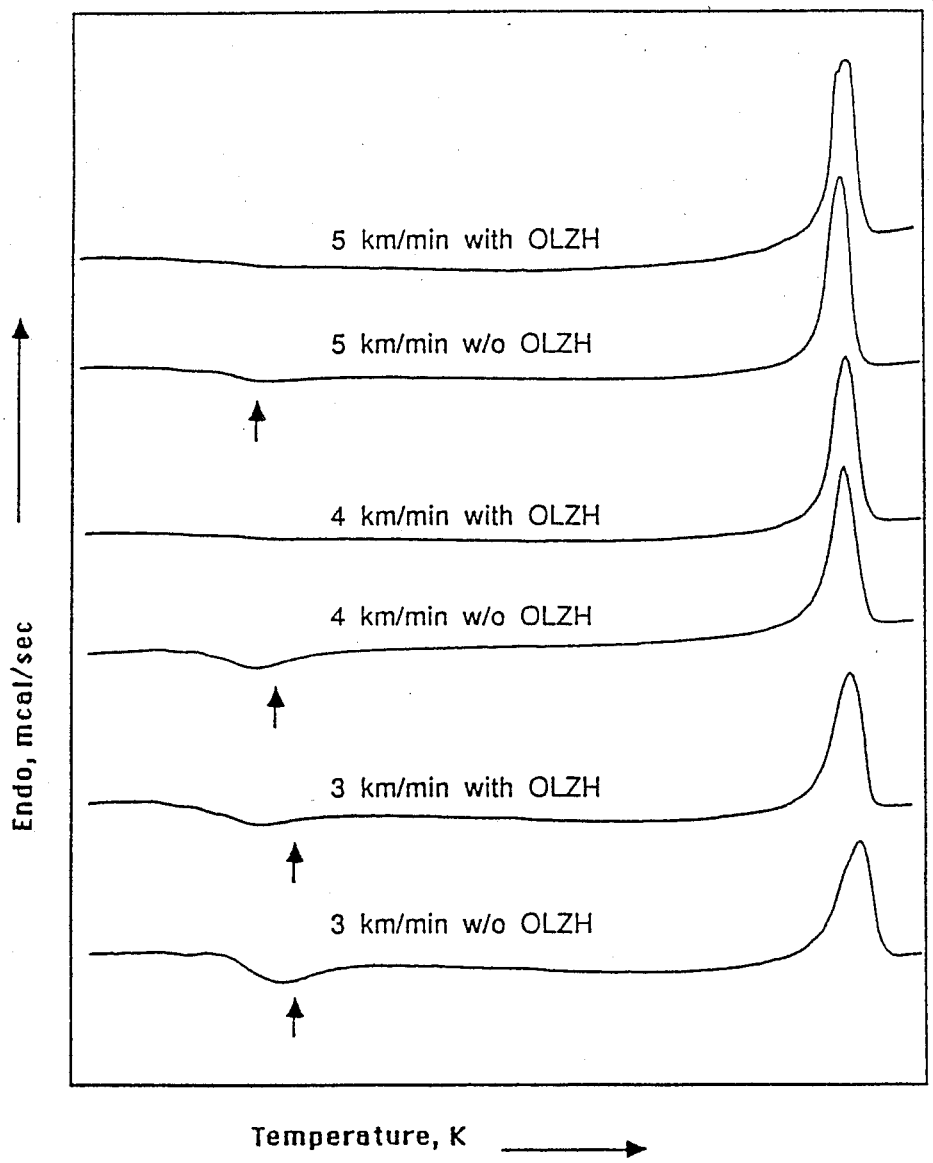
FIG. 11 shows the differential scanning calorimetry curves for various fiber samples produced with and without the present invention.

FIG. 11 shows the DSC curves of various fiber samples. As take-up speed increases, the cold crystallization peak (indicated by arrows) becomes less and less visible and moves toward a lower temperature. For a given take-up speed, the crystallization peak of the fiber spun with on-line cooling and heating is smaller and occurred at lower temperature than that of the conventionally spun fiber. The difference in the thermal behavior is probably due to the different extent of crystallinity and crystalline perfection in the fiber samples. The DSC scans of the fibers spun with on-line cooling and heating at 4000 and 5000 m/min show essentially no cold crystallization peak, meaning that the fibers are almost fully crystallized and that the crystallites are well developed.

Based on the X-ray diffraction patterns of the fiber samples, quantitative results regarding crystal structure were also obtained. The apparent crystal size, observed d-spacing and number of repeat units are listed in Table 1. At 3000 m/min, it seems that the crystal structure is not seriously affected by on line cooling and heating; however, the apparent crystal size and the number of repeat units are significantly increased by this invention at take-up speeds of 4000 m/min and 5000 m/min.

TABLE 1

Data of crystalline dimension L(hkl), Å, observed d-spacing d(hkl), Å, and number of repeat units N(hkl) for respective (hkl) reflection planes of PET fibers produced with and without OLZH at different take-up speeds.

| Speed | 3000 | | 4000 | | 5000 | |
|---|---|---|---|---|---|---|
| (m/min) | w/o OLZH | with OLZH | w/o OLZH | with OLZH | w/o OLZH | with OLZH |
| L(010) | 16.44 | 11.16 | 18.10 | 29.09 | 27.24 | 30.38 |
| L($\bar{1}$10) | 16.20 | 12.14 | 16.05 | 26.32 | 26.10 | 32.38 |
| L(100) | 13.59 | 13.51 | 14.98 | 32.12 | 25.67 | 33.29 |
| d(010) | 4.94 | 5.01 | 4.85 | 5.00 | 4.89 | 4.98 |
| d($\bar{1}$10) | 4.03 | 4.02 | 4.04 | 3.89 | 3.86 | 3.90 |
| d(100) | 3.49 | 3.49 | 3.42 | 3.41 | 3.38 | 3.42 |
| N(010) | 3.33 | 2.23 | 3.74 | 5.82 | 5.57 | 6.10 |
| N($\bar{1}$10) | 4.02 | 3.02 | 3.97 | 6.77 | 6.76 | 8.30 |
| N(100) | 3.90 | 3.87 | 4.38 | 9.42 | 7.59 | 9.73 |

Figure 12:
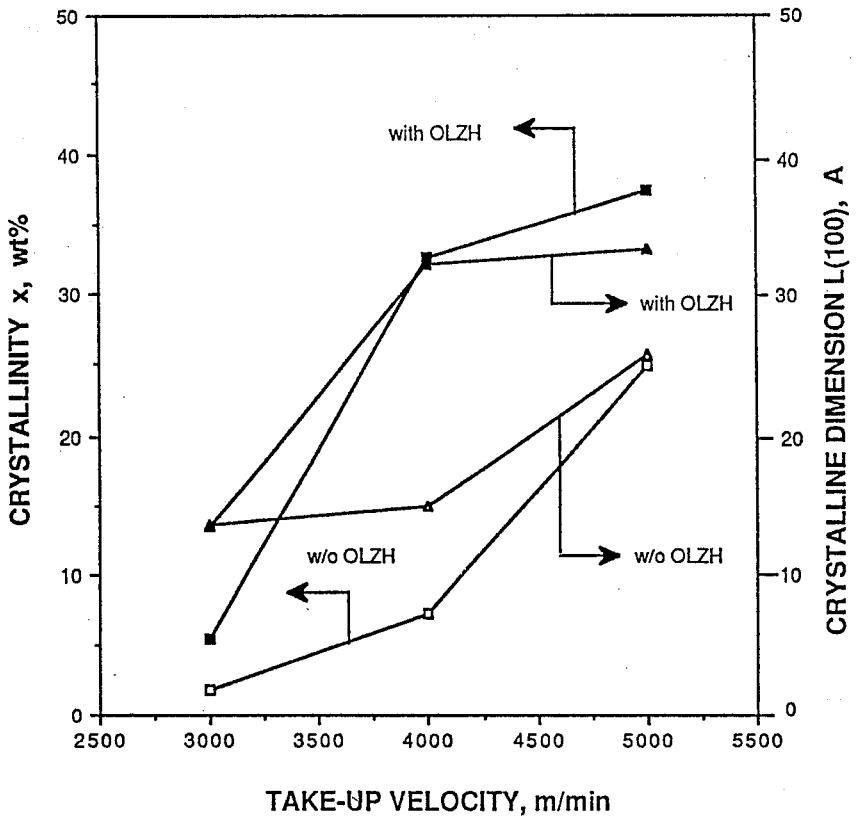
FIG. 12 is a graph showing the effect of the present invention on crystallinity and crystalline dimension.

FIG. 12 illustrates the effect of on-line zone cooling and heating on both crystallinity and crystalline dimension. At 3000 m/min, the crystalline dimension remains unchanged while crystallinity increases slightly, and both crystallinity and crystalline dimension are remarkably increased at 4000 and 5000 m/min take-up speeds. This result is consistent with the DSC observation.

Data of tensile properties of the PET fibers spun at 3000 to 5000 m/min are listed in Table 2. In general, the fiber tenacity and modulus are increased while the elongation at break is reduced with the introduction of OLZH. As compared with the literature data, the fibers spun with OLZH have higher tenacity and modulus and lower elongation at break. At 5000 m/min, the fiber spun with OLZH has a tenacity of 4.25 g/d, which is very close to the tenacity value of 4.3 for duPont drawn yarn.

TABLE 2

Tensile Properties of PET Fibers from different sources.

| Speed (MPM) | Property (gf/d) | Our Data (IV 0.57) w/o OLZH | with OLZH | Yasuda (1) (IV 0.60) | Vassilatos (1) (IV 0.65) |
|---|---|---|---|---|---|
| 3000 | Tenacity | 3.00 | 3.20 | 2.85 | — |
| | Elong. % | 150 | 116 | 150 | 135 |
| | Modulus | 23.8 | 33.2 | — | — |
| 4000 | Tenacity | 3.53 | 3.80 | 3.35 | 2.22 |
| | Elong. % | 125 | 94.3 | 87.0 | 94.0 |
| | Modulus | 33.5 | 48.2 | — | — |
| 5000 | Tenacity | 3.95 | 4.25 | 3.71 | 3.04 |
| | Elong. % | 67.9 | 64.0 | 60.0 | 64.0 |
| | Modulus | 56.0 | 59.0 | — | — |
| | | DTFY* | Undrawn Yarn | | Drawn Yarn |
| duPont Feed Yarn (2) | Tenacity | 2.2 | 1.2 | | 4.3 |
| | Elong. % | 130 | 400 | | 30 |
| | Modulus | 30 | 22 | | 110 |

Ref. (1). A. Ziabicki and H. Kawai, Eds., "High-Speed Fiber Spinning", John Wiley & Sons, New York 1985

Ref. (2). O. L. Shealy and R. E. Kitson, Textile Research Journal, P. 112, February 1975.

*Draw-Texturing Feed Yarn.

The drawings and specification have disclosed a typical preferred embodiment and an example of the invention. Although specific terms are employed, they are used in a generic and descriptive sense only and not for purposes of limitation, the scope of the invention being set forth in the following claims.

That which we claim:

1. A high speed melt spinning process for producing textile fibers having improved physical properties, comprising extruding a molten polymer from a spinneret to form continuous strands, directing the molten polymer strands from the spinneret into and through a first cooling zone and rapidly cooling the strands from the extrusion temperature to a predetermined optimum crystallization temperature range above the glass transition temperature of the strands, directing the strands from the first cooling zone into and through a heating zone and heating the strands so as to maintain the strands for a period of time at a temperature within said optimum crystallization temperature range, directing the strands from the heating zone to a second cooling zone and cooling and solidifying the strands, and taking up the strands at a high speed of 3000 meters per minute or greater.

2. A process according to claim 1 wherein the step of heating the material comprises maintaining the strands in a substantially isothermal condition.

3. A process according to claim 1 wherein the step of heating the strands maintains a temperature between 80° C. and 160° C.

4. A process according to claim 1 wherein the step of heating the strands maintains a substantially isothermal temperature of approximately 140° C.

5. A process according to claim 1 wherein the step of cooling the strands comprises contacting the strands with cool air.

6. A process according to claim 1 wherein the step of heating the strands comprises contacting the strands with heated air.

7. A process according to claim 1 wherein the strands are heated for a period of time less than 0.005 seconds.

8. A high speed melt spinning process for producing textile fibers having improved physical properties, comprising extruding molten polyethylene terephthalate polymer from a spinneret to form continuous strands, directing the molten polyethylene terephthalate strands from the spinneret into and through a first cooling zone and cooling the molten strands with cool air to a predetermined optimum crystallization temperature range between 80° C. and 160° C., directing the strands from the first cooling zone into and through a heating zone and heating the strands with heated air so as to maintain the strands for a time less than 0.005 seconds at a temperature within said optimum crystallization temperature range between 80° C. and 160° C., directing the strands from the heating zone to a second cooling zone and cooling and solidifying the strands with cool air, and taking up the strands at a high speed of 3000 meters per minute or greater.

9. The process of claim 8 wherein the step of heating the strands maintains a temperature of approximately 140° C.

10. The process of claim 8 wherein the step of cooling the strands with cool air uses air at 23° C. flowing at approximately 300 feet per minute.

* * * * *

UNITED STATES PATENT AND TRADEMARK OFFICE

CERTIFICATE OF CORRECTION

PATENT NO. : 4,909,976

DATED : March 20, 1990

INVENTOR(S) : John A. Cuculo, et al.

It is certified that error appears in the above-identified patent and that said Letters Patent is hereby corrected as shown below:

Column 2, line 29, "theological" should be -- rheological --.

Column 2, line 56, "threadlines" should be -- Threadline --.

Column 6, line 49, "154" should be -- 1954 --.

Column 6, line 51, "CuKα" should be -- CuK∝ --.

Column 6, line 57, "(110)" should be -- $(\bar{1}10)$ --.

Column 7, line 4, "$L_{hkl} - {}^{80}/\beta\cos\theta$" should be -- $L_{hkl} = {}^{\lambda}/\beta\cos\theta$ --.

UNITED STATES PATENT AND TRADEMARK OFFICE

CERTIFICATE OF CORRECTION

PATENT NO. : 4,909,976

DATED : March 20, 1990

INVENTOR(S) : John A. Cuculo, et al

It is certified that error appears in the above-identified patent and that said Letters Patent is hereby corrected as shown below:

Column 7, line 8, "(110)" should be -- ($\bar{1}$10) --.

Column 7, line 11, "Phvs." should be -- Phys. --.

Column 9, line 67, after "molten" insert -- polyethylene terephthalate --.

Signed and Sealed this

Sixteenth Day of July, 1991

*Attest:*

*Attesting Officer*

HARRY F. MANBECK, JR.

*Commissioner of Patents and Trademarks*